US012270129B2

(12) United States Patent
Bommer

(10) Patent No.: US 12,270,129 B2
(45) Date of Patent: Apr. 8, 2025

(54) COMBING DEVICE FOR COMBING A FIBER MATERIAL

(71) Applicant: Maschinenfabrik Rieter AG, Winterthur (CH)

(72) Inventor: Daniel Bommer, Elsau (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 17/964,094

(22) Filed: Oct. 12, 2022

(65) Prior Publication Data

US 2023/0123666 A1 Apr. 20, 2023

(30) Foreign Application Priority Data

Oct. 14, 2021 (CH) ..... 70396/2021

(51) Int. Cl.
*D01G 19/10* (2006.01)
*D01G 19/16* (2006.01)
*D01G 19/26* (2006.01)

(52) U.S. Cl.
CPC ..... *D01G 19/10* (2013.01); *D01G 19/16* (2013.01); *D01G 19/26* (2013.01)

(58) Field of Classification Search
CPC ..... D01G 19/10; D01G 19/16; D01G 19/24; D01G 19/26; D01G 31/006
USPC ..... 19/225, 228, 235
See application file for complete search history.

(56) References Cited

U.S. PATENT DOCUMENTS 4,951,360 A * 8/1990 Kishi ..... D01G 19/26 19/235
5,148,575 A * 9/1992 Clement ..... D01G 19/16 19/235
5,255,416 A * 10/1993 Eichenberger ..... D01G 19/16 19/225
5,369,844 A * 12/1994 Locatelli ..... D01G 19/26 19/0.2

(Continued)

FOREIGN PATENT DOCUMENTS

CH 714 580 A2 7/2019
DE 196 19 953 A1 1/1997

(Continued)

OTHER PUBLICATIONS

CH Search Report, Dec. 10, 2021.

*Primary Examiner* — Aiying Zhao
(74) *Attorney, Agent, or Firm* — Dority & Manning, P.A.

(57) ABSTRACT

A combing machine includes a machine frame, drive unit, gearing mechanism, operating device, and nipper unit pivotably mounted in the machine frame and having a lower nipper plate with a nipper lip and an upper nipper plate. The combing machine also includes a pair of detaching rollers forming a clamping line, wherein a drive arm of the nipper unit is connected to an intermittently-driven nipper shaft in a rotationally-fixed manner. The nipper shaft is driven by means of a coupling element, which is connected to a driven gearing element. An adjusting device connected to the nipper shaft is provided for adjusting a distance between the nipper lip and the clamping line. The gearing mechanism also includes a fixation in a basic position with a mechanical blocking, and a sensor for measuring the distance or a variable proportional to the distance, and a display of the distance on the operating device.

9 Claims, 3 Drawing Sheets

(56) References Cited

U.S. PATENT DOCUMENTS

| | | | | |
|---|---|---|---|---|
| 2009/0000068 | A1* | 1/2009 | Saeger | D01G 19/16<br>19/115 R |
| 2015/0240392 | A1* | 8/2015 | Peulen | D01G 19/26<br>19/235 |
| 2017/0167056 | A1* | 6/2017 | Bommer | D01G 19/26 |

FOREIGN PATENT DOCUMENTS

| | | | | |
|---|---|---|---|---|
| DE | 102 06 605 | A1 | 8/2003 | |
| DE | 102006002390 | A1 * | 7/2007 | D01G 19/08 |
| EP | 0396502 | A1 * | 11/1990 | D01G 19/26 |
| EP | 3514271 | A1 * | 7/2019 | D01G 19/24 |
| WO | WO 2012/035543 | A1 | 3/2012 | |

* cited by examiner

COMBING DEVICE FOR COMBING A FIBER MATERIAL

FIELD OF THE INVENTION

The invention relates to a combing machine with a device for adjusting a distance between a nipper lip of a lower nipper plate and a lower detaching roller.

BACKGROUND

Combing machines have a reciprocating nipper unit, which introduces the combed fiber tuft to a subsequent pair of detaching cylinders for detaching, wherein the front end of the fiber tuft is transferred into the clamping line of the detaching cylinders. During this detaching process, the nipper is in its front position and is open. During the detaching process, the fiber bundle pulled out of the introduced batting is pulled, at least with its rear end, through a top comb. As a result, any impurities (such as shell parts, but also burls) still present in the fiber stock are retained and discarded.

The nipper unit in the previously described machine is mounted on each side on two pivot arms. The front pivot arm is mounted on the circular comb axis, while the respective rear pivot arm is fastened to an intermittently-driven nipper shaft in a rotationally-fixed manner. Within a gearing mechanism, the nipper shaft is driven by a vibrating hub which is connected to the shaft in a rotationally-fixed manner via a clamping bush. The nipper shaft is intermittently moved by a push rod, which is fastened to the vibrating hub and is mounted in a receptacle, which is moved on a control disk.

In order to change the noil percentages (proportion of the combed, short fibers), it is necessary to adjust the distance of the nipper from the clamping line of the subsequent pair of detaching cylinders at the front reversal point (dead center) of the nipper movement accordingly. This distance is generally referred to as "ecartement." In the case of a larger ecartement, the proportion of the noil percentages is increased; in the case of a smaller ecartement, it is decreased accordingly. Even a deviation of 0.1 mm in the ecartement affects the noil percentage.

A generic adjusting device is disclosed in DE 102 06 605 A1. In order to change the front reversal point of the nipper movement and thus the ecartement, a clamping connection between the nipper shaft and a clamping bush is released. In order to rotate the nipper shaft in its circumferential direction relative to the clamping bush, an existing locking device between the nipper shaft and the clamping bush must be released or readjusted. This locking device can consist of a rod which is fastened to the end face of the nipper shaft and projects radially outwards and in which adjusting screws are provided, which are arranged at a distance from one another and are clamped in the locking position against a tab fastened to the end face of the clamping bush. On the outer circumference of the clamping bush, in the known embodiments, a scale is provided, which has several graduation lines arranged next to one another and is opposite a marking notch, which is placed in the corresponding outer surface of the rod fastened to the nipper shaft.

In order to now rotate the nipper shaft relative to the clamping bush, after the clamping connection of the clamping bush has been released, one of the adjusting screws of the tab must be released, while the other adjusting screw is readjusted accordingly. The nipper shaft must be rotated relative to the clamping bush until the notch on the rod is opposite the desired graduation line on the scale of the clamping bush. With this device, it was previously possible to carry out a rough adjustment of the ecartement, wherein additional aids, such as measuring gauges, sensors, etc., were, however, necessary for the fine adjustment in order to set correspondingly precise values. DE 102 06 605 A1 attempts to eliminate this disadvantage by proposing to adjust the ecartement with the aid of a Nonius scale, as a result of which the use of measuring gauges is omitted.

A disadvantage of this solution is that an exact adjustment is still imprecise due to the mechanical scale, and the adjustment must take place at a certain position of the gearing mechanism, viz., the position at which the nipper unit reaches the dead center. Finding this position of the gearing mechanism is complicated and in turn requires suitably trained personnel. Furthermore, in order to ensure the correct adjustment and to avoid incorrect adjustments, a post-measurement with a measuring gauge is still required, as is shown in practice.

SUMMARY OF THE INVENTION

The invention is thus based upon an object of proposing a combing machine with a device that eliminates the known disadvantages and enables simple and precise adjustment of the ecartement in a predetermined position of the gearing mechanism. Additional objects and advantages of the invention will be set forth in part in the following description, or may be obvious from the description, or may be learned through practice of the invention.

To achieve the objects, a combing machine is proposed with a machine frame, a drive unit, a gearing mechanism, and an operating device for displaying and inputting values, and with a nipper unit which is pivotably mounted in the machine frame and has a lower nipper plate with a nipper lip and an upper nipper plate, and with a pair of detaching rollers which forms a clamping line. A drive arm of the nipper unit is connected in a rotationally-fixed manner to an intermittently-driven nipper shaft, and the nipper shaft is driven by means of a coupling element which is connected to a driven gearing element. An adjusting device is connected to the nipper shaft for adjusting a distance between the nipper lip of the lower nipper plate and the clamping line. Furthermore, a fixation of the gearing mechanism in a basic position with a mechanical blocking, and a sensor for measuring the distance or a variable proportional to the distance, and a display of the distance on the operating device are provided.

In most cases, the nipper shaft is driven via a nipper auxiliary shaft. A drive wheel is attached in a rotationally-fixed manner to the nipper auxiliary shaft. This drive wheel is put into continuous rotation by a gearing element. The gearing element can, for example, be a toothed wheel which is in engagement with the drive wheel of the nipper auxiliary shaft, or also a toothed belt. Alternatively, the nipper auxiliary shaft can be provided with a separate drive, which is linked by control technology to further drives to form an electronic gearing mechanism. In one development, it is also conceivable for the nipper shaft to be directly put into an intermittent movement by its own drive. However, this drive is also useful only in combination with the remaining drives of the combing machine. By means of a coupling element, the nipper shaft is put into a discontinuous movement by the continuously-rotating nipper auxiliary shaft, so that a reciprocating movement of the nipper plate is achieved.

Preferably, the coupling element is configured as a cam disk attached in a rotationally-fixed manner to the nipper auxiliary shaft, a cam roller resting against the cam disk, and a cam roller lever which is held in a rotationally-fixed manner on the nipper shaft and in which the cam roller is rotatably mounted. Such drives are known from the prior art and are described in, for example, CH 714 580 A2. The adjusting device necessary for adjusting the ecartement is likewise known in various embodiments from the prior art; one possible embodiment is taken from DE 102 06 605 A1 and described above.

The fixation of the gearing mechanism can be provided at various locations, whereas the location of the use of a mechanical blocking is dependent upon the design of the gearing mechanism. A mechanical blocking has the advantage that a defined position of the gearing element is detected by the blocking, and the mechanical blocking, e.g., by a pin, keeps the gearing mechanism in exactly this defined position, without play. For example, the gearing mechanism can be blocked by means of a gearing element of the gearing mechanism, such as the drive wheel of the nipper auxiliary shaft. It is advantageous if the fixation of the gearing mechanism is provided by a blocking of the cam disk. The freedom from play of the blocking is important, because even a minimum play of a few hundredths of a millimeter contributes to an inaccuracy of the adjustment of the ecartement. It is also advantageous if the gearing mechanism is blocked as close as possible to the nipper shaft, so that existing play between the individual gearing elements likewise does not have a negative effect upon the accuracy of the adjustment of the ecartement.

Furthermore, a sensor is provided which directly or indirectly measures the ecartement or the distance between the nipper lip of the lower nipper plate and the clamping line of the pair of detaching rollers. The sensor can be constructed as an optical sensor and can directly detect the ecartement. A rotary encoder assigned to the nipper shaft would also provide a variable, proportional to the distance, for determining the ecartement. However, a preferred embodiment is the use of a simple distance sensor—for example, of a capacitive or inductive design. An eccentric towards which the distance sensor is radially oriented is attached to the nipper shaft outside the drive unit. A distance between the sensor and the eccentric now changes with the change in the radial position of the nipper shaft. A certain distance between the sensor and the eccentric results in the now predetermined blocked position of the nipper shaft, and thus also of the eccentric. By calibrating the size of the ecartement with respect to the position of the eccentric, the distance between the sensor and the eccentric can be brought into direct relation to the ecartement. It is thus possible to convert the distance proportional to the ecartement in a control unit and to display it as ecartement or as distance between the clamping line of the pair of detaching rollers and the nipper lip of the lower nipper plate on the operating device.

The operating device used here can be rigidly fastened to the combing machine. However, a mobile device which can communicate with the control unit of the combing machine is also to be understood as an operating device. All devices which have a display and an input field or, alternatively, a touchscreen are suitable for use as an operating device in the sense of the invention.

After a displacement of the ecartement, i.e., of the front end position (adjacent to the detaching cylinder) of the oscillating nipper unit, the degree of combing can be changed, or an adaptation to the stack of fibers to be combed can be achieved. However, since the top comb needles in the front end position of the nipper unit should in any case have a predetermined, very small distance from the detaching cylinder, a displacement of the top comb holders with respect to the lower nipper is also necessary after a displacement of the ecartement, in order to adjust this predetermined distance again.

Preferably, the basic position corresponds to that position of the gearing mechanism in which the distance between the nipper lip of the lower nipper plate and the clamping line of the pair of detaching rollers is the smallest. In order to achieve this, exactly at this gearing mechanism position, the blocking provided engages mechanically into the gearing element provided for this purpose and locks any movement of the gearing mechanism. The fixation of the gearing mechanism is, advantageously, designed as a latching lever. A latching lever is understood to mean a pin which latches into a depression or bore during movement, wherein the latching usually takes place under spring pressure. In order to get the latching lever out of the latching engagement, the latching lever must be moved out of the latching position against a spring force.

Preferably, the device for adjusting the distance is attached behind a protection device. In order to avoid unintentional handling, and also as protection against contamination, a protective device is provided. Simple covers or also doors are conceivable as protective devices, and the protective devices can be designed to be transparent. Doors of the machine or gear housing can also be understood as protective devices. If housing doors are already provided at the relevant location at which the adjusting device is provided, no additional protective devices are necessary.

It is advantageous if a size of the display of the distance on the operating device can be changed. This is, above all, advantageous when the operating device is not attached in close proximity to the adjusting device. By switching the display size, it is possible to achieve a reading of the ecartement without the operating personnel having to move away from the adjusting device. An alternative solution is preferably provided when the operating device has an additional display in the region of the device for adjusting the distance. The region of the device for adjusting the distance is to be understood as the immediate surroundings of the device. The additional display is arranged in such a way that easy reading of the display by personnel making the adjustment is possible. In this case, the display can be fastened at a suitable location in this region, wherein the building or installations or apparatuses not belonging to the combing machine can constitute a suitable location for fastening the additional display. Preferably, the display and/or the operating device is fastened to the combing machine or the conveyor belt in a rotatable and/or displaceable manner, as a result of which optimal adjustment to the viewing angle of the operator can be achieved.

Furthermore, a method for adjusting a combing machine according to the above description is proposed, with the following method steps:

- transferring the gearing mechanism of the combing machine into a basic position;
- fixing the gearing mechanism in the basic position with the mechanical blocking;
- switching the operating device to the display of the distance between the nipper lip of the lower nipper plate and the clamping line;
- releasing a connection between the coupling element and the nipper shaft;
- adjusting an intended distance with the aid of the adjusting device and the display of the distance on the operating device;

securing the connection between the coupling element and the nipper shaft;

releasing the blocking of the gearing mechanism.

Advantageously, the display of the operating device automatically switches to a measurement value display of the distance when the protective device is opened and the connection between the coupling element and the shaft is released. Likewise, when the protective device is closed, the display preferably switches automatically back to a state before the adjustment. The work of the operating personnel is substantially accelerated by such a simple, automatic system. This automatic switching of the display can also refer to an additional display in the adjusting device, wherein this display would in each case be switched on and off.

Furthermore, the measurement of the distance can also be used during the operation of the combing machine. As a result of the reciprocating movement of the nipper shaft, the measured distance between the sensor and the eccentric moves within a predetermined range. If, as a result of a malfunction in the drive, in the gearing mechanism, or in the connection from the nipper shaft to the nipper plate, the nipper shaft is now displaced in its radial position relative to the adjustment, this can be registered by the sensor. It is also possible to define a range in which the combing machine has to be switched off, since a collision between the nipper lip and the top comb is imminent. By means of such a monitoring of the distance, damage can be avoided with the aid of the sensor; the sensor is used as a crash sensor.

BRIEF DESCRIPTION OF THE DRAWINGS

The invention is shown and explained in more detail with reference to an exemplary embodiment below. In the drawings.

DETAILED DESCRIPTION

Figure 1:
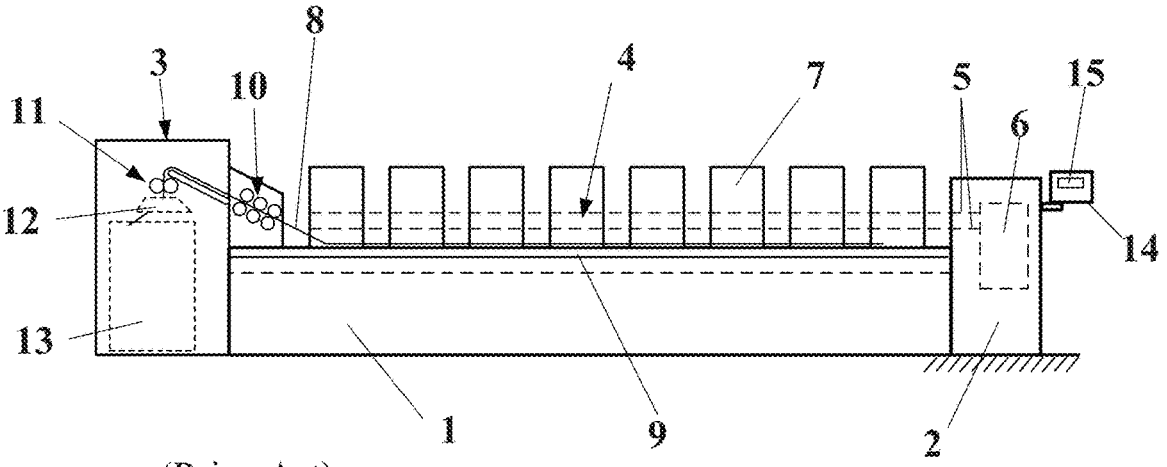
Fig. 1 (Prior Art)
FIG. 1 shows a schematic view of a combing machine according to the prior art.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic view of a combing machine according to the prior art. The combing machine comprises a machine frame 1 as well as a drive unit 2 and a conveyor belt 3. The machine frame 1 is arranged between the drive unit 2 and the conveyor belt 3 and, according to the example shown, carries eight combing heads 4. The combing heads 4 are connected to the drive unit 2 via drive shafts 5. The individual components of the combing heads 4 are driven by a gearing mechanism 6 arranged in the drive unit 2. By means of the combing heads 4, a batting unwound from a batting roll 7 is combed and fed to a conveyor table 9. The combed fibers of the individual combing heads are combined via the conveyor table 9 and fed as a fiber strip 8 to a stretching unit 19. After the stretching unit, the fiber strip 8 is filled by means of calender rollers 11 and a turntable 12 in a loop-like manner into a canister 13. An operating device 14 with a display 15 is fastened to the drive unit 2 by way of example.

Figure 2:
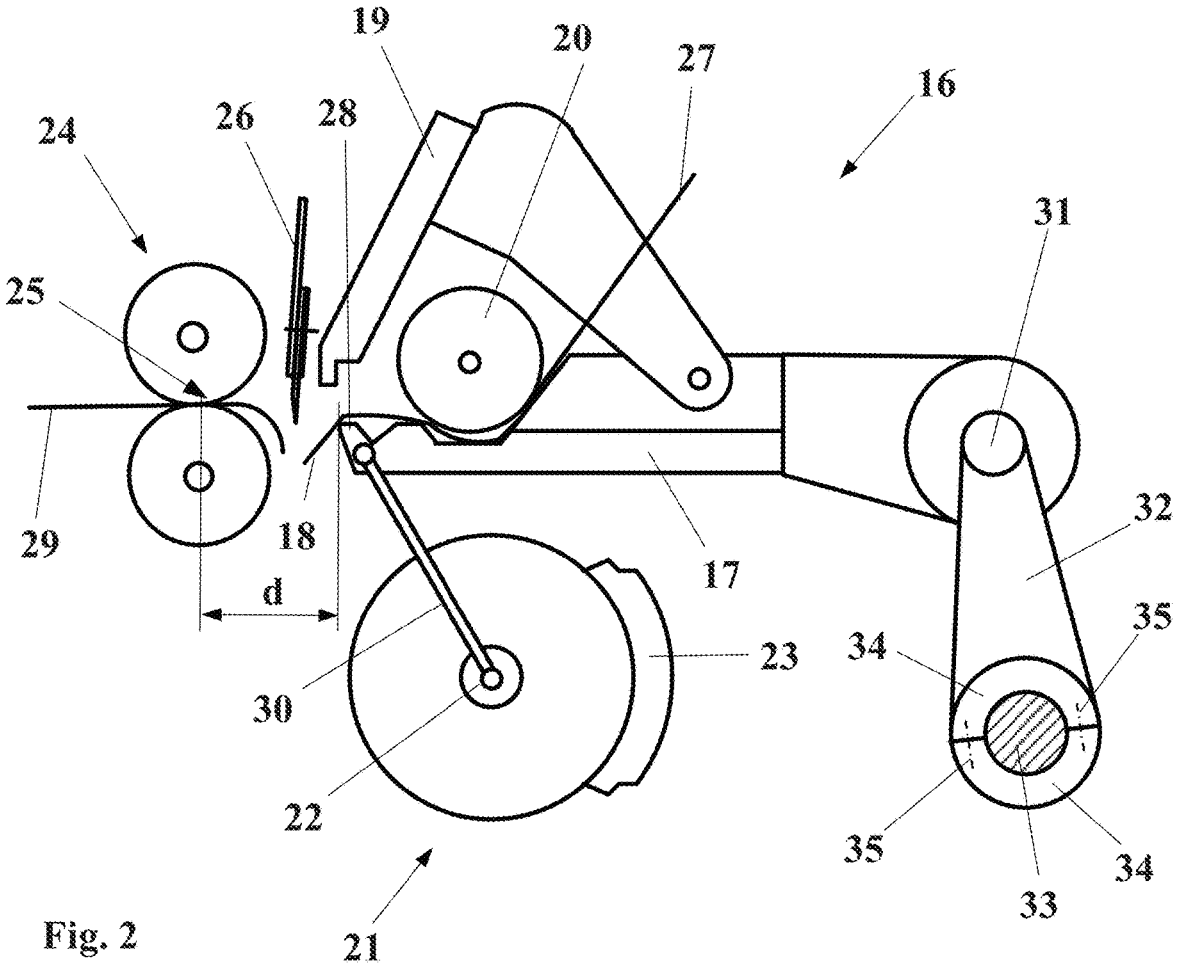
FIG. 2 shows a schematic side view of a nipper unit with drive shaft.

FIG. 2 shows a nipper unit 16 with a lower nipper plate 17 and an upper nipper plate 19 mounted pivotably on the lower nipper plate 17. The lower nipper plate 17 has a nipper lip 28. In the nipper unit 16, a feed cylinder 20 is rotatably mounted, which carries out a discontinuous movement during a combing cycle in order to introduce the batting web 27 unrolled from a roll (not shown) to a circular comb 21 for combing, which circular comb is rotatably arranged below the nipper unit 16. During this combing process, the nipper unit 16 is in a rear position (not shown), wherein the nipper unit 16 is closed. The end 18 (fiber tuft) projecting out of the nipper unit 16 is then combed by the circular comb segment 23. Afterwards, the nipper unit 16 is transferred into the front position shown in FIG. 2, in which it is open. In this position, a top comb 26 penetrates into the batting end projecting beyond the nipper unit 16. During the forward movement of the nipper unit 16, the batting end reaches a clamping line 25 of a subsequent pair of detaching rollers 24 and is soldered there to a nonwoven 29.

In order to carry out the reciprocating pivoting movement of the nipper unit 16, the latter is supported in its front region on both sides on pivot arms 30, which are rotatably mounted on the lower nipper plate 17 and on a stationary circular comb axis 22. In the rear region of the nipper unit 16, the latter is supported via drive arms 32 which are arranged in parallel to one another and are mounted rotatably on the axis 31 of the nipper unit 16. On their opposite end, the drive arms 32 are connected in a rotationally-fixed manner to a stationarily-mounted nipper shaft 33. This rotationally-fixed connection takes place via the clamping force of the schematically indicated screws 35, which clamp the schematically indicated half-shells 34 of the working arm 32 against the nipper shaft 33. The nipper movement is driven via a discontinuous movement of the nipper shaft 32, which is described in more detail below.

The nipper unit 16 in the position shown in FIG. 2 is in a foremost position (front dead center), from which the backward movement of the nipper unit 16 subsequently takes place. In this front position, the nipper lip 28 of the lower nipper plate 17 has a distance d from the clamping line 25 of the pair of detaching rollers 24, which is generally referred to as an ecartement. In order to determine the proportion of the short fiber content (noils) to be combed, this distance "d" must be adjusted accordingly. This adjustment takes place by changing the position of the rotational angle, which is generated by the nipper shaft 33 during a combing cycle. This means that, depending upon the desired increase or reduction of the ecartement "d", the rotational angle generated by the nipper shaft 33 must be displaced in the circumferential direction of the nipper shaft 33 in one or the other direction. This takes place with an adjusting device 44 (not shown here).

Figure 3:
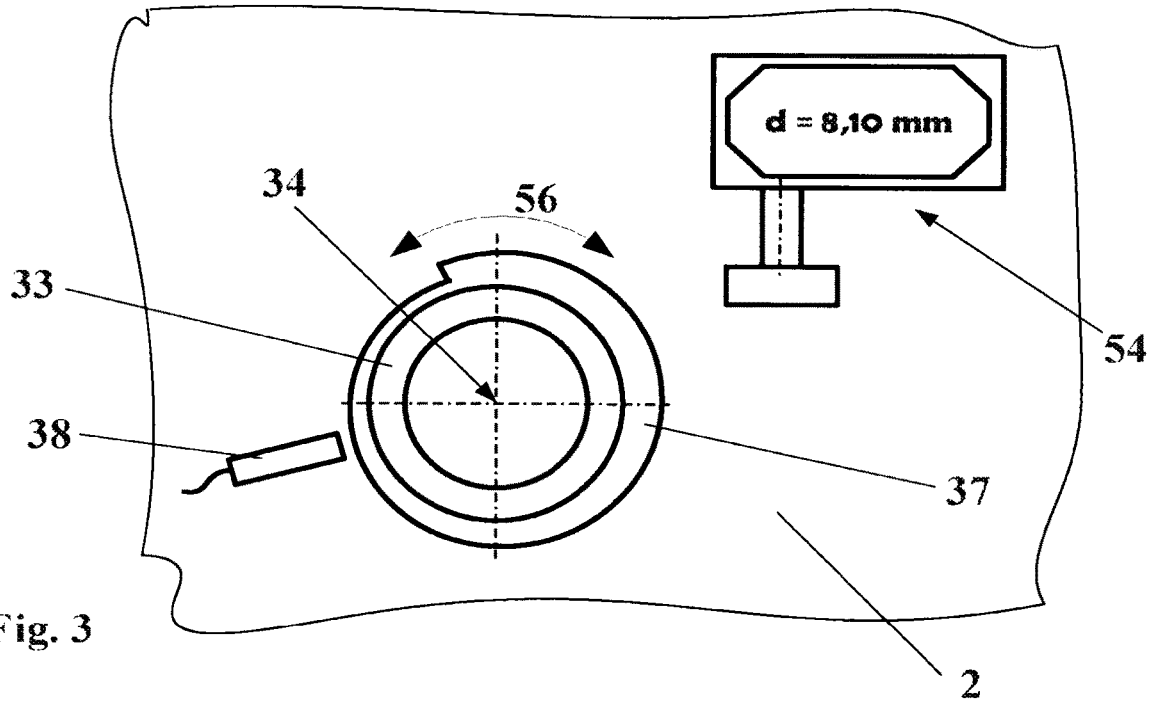
FIG. 3 shows a partial view of the nipper shaft in the region outside the machine frame.

FIG. 3 shows a partial view of the nipper shaft 33 in a region outside the gearing mechanism 6 or the drive unit 2. An eccentric 37 is attached to the nipper shaft 33 with its nipper shaft axis 34. A distance sensor 38 is directed towards the eccentric 37 and measures the distance between itself and an outer surface of the eccentric 37. Furthermore, by way of example, an additional display 54 is shown, which is fastened to the drive unit 2. The additional display 54 is rotatably held on the drive unit 2 and shows the current value of the ecartement "d". If the nipper shaft 33 is now rotated about the nipper shaft axis 23 in its radial position by the adjusting device, the distance of the outer surface of the eccentric 37 from the distance sensor 38 changes. This measured distance is proportional to the ecartement "d". By means of a prior calibration of this proportionality, the ecartement d is displayed directly on the additional display 54 during the adjustment process.

During normal operation of the combing machine, the nipper shaft 33 performs a reciprocating movement (arrow 56). This reciprocating movement takes place in a specific range of the ecartement "d" known to the control unit. By the measurement of the distance sensor 38, the control unit can monitor whether the movement 54 of the nipper shaft 33 moves in this predetermined range or deviates therefrom. In the case of a deviation, there is a risk of collision, and the combing machine can be switched off by the control unit or a warning can be output to the operator.

Figure 4:
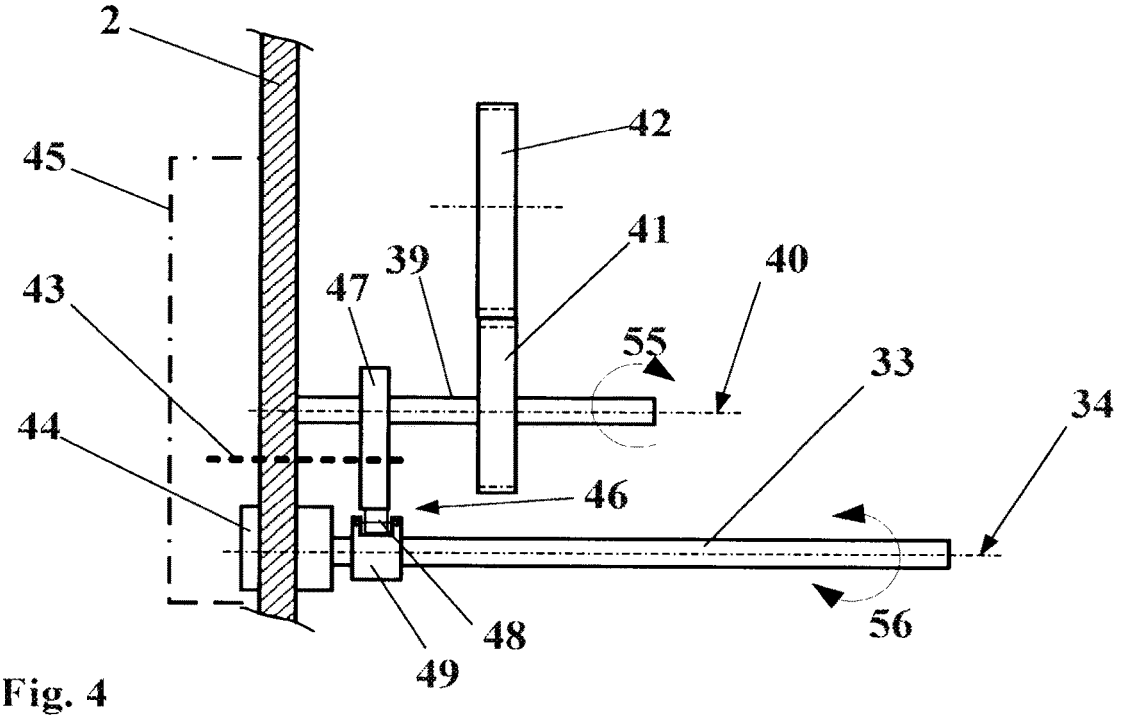
FIG. 4 shows a schematic view of a portion of the gearing mechanism.

FIG. 4 shows a schematic view of a portion of the gearing mechanism 6, which contains the drive of the nipper unit. By means of a driven gearing element 42, shown by way of example as a toothed wheel, a nipper auxiliary shaft 39 is put via a drive wheel 41 into a continuous rotational movement 55 about the nipper auxiliary shaft axis 40. With the aid of a coupling element 46, consisting of a cam disk 47 which is attached in a rotationally-fixed manner to the nipper auxiliary shaft 39, a cam roller 48 resting against the cam disk 47, and a cam roller lever 49 which is held in a rotationally-fixed manner on the nipper shaft 33 and in which the cam roller 48 is rotatably mounted, a discontinuous drive of the nipper shaft 33 is created from the continuous rotational movement 54 of the nipper auxiliary shaft 39. This results in a reciprocating movement 56 of the nipper shaft 33 about its nipper shaft axis 34. The various components are held appropriately in a rotationally-fixed or rotatable manner in the drive unit 2.

In the region of the cam disk, a blocking 43 for the gearing mechanism is provided by way of example. With the blocking, the cam disk 47 and thus also the nipper auxiliary shaft 39, as well as the drive wheel 41 and the gearing element 42, as well as further gear parts connected to the gearing element 42, are blocked in a predetermined position. An adjusting device 44 is shown schematically in simplified form on the nipper shaft axis 34. The adjusting device 44 is connected to the coupling element 46 and extends up to an outer side of the drive unit 2. The adjusting device 44 is used to adjust the ecartement when the nipper auxiliary shaft 39 is blocked. In this case, the radial position of the nipper shaft 33 relative to the coupling element 46 is changed.

Attached on the outer side of the drive unit 2 is a protective device 45 which protects the blocking 43 and the adjusting device 44 from external influences and also undesired access. The protective device 45 may correspond to the gearing mechanism cover or be designed as a separate, detachable or pivotably-attached cover.

Figure 5:
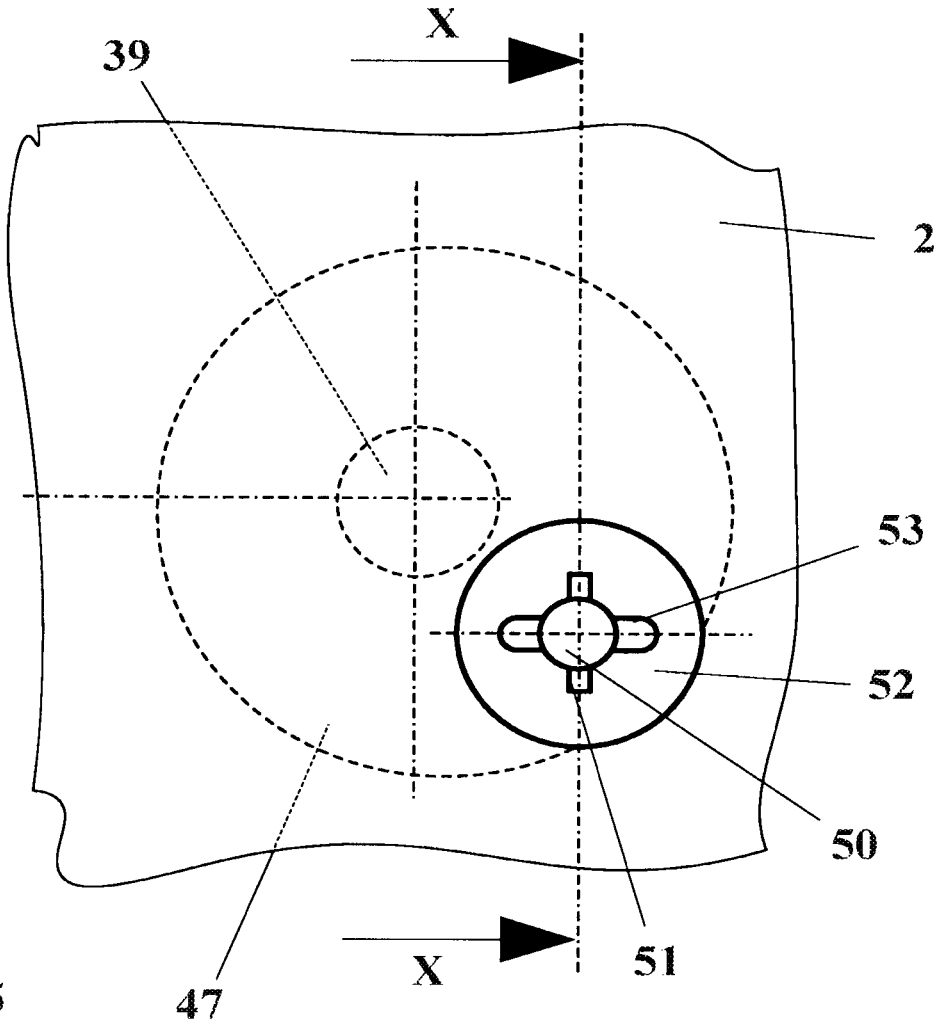
FIG. 5 shows a schematic plan view of the mechanical blocking of the gearing mechanism.
Figure 6:
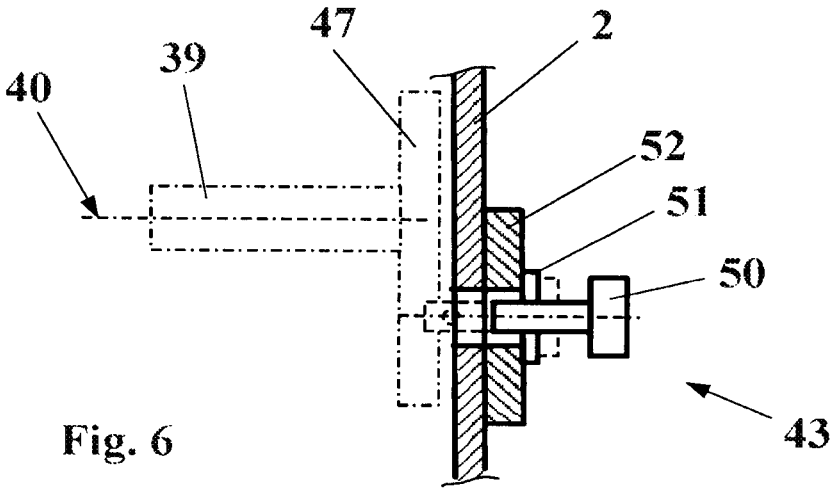
FIG. 6 shows a schematic sectional view at the point X-X according to FIG. 5.

FIG. 5 shows a schematic plan view of the mechanical blocking 43 of the gearing mechanism, and FIG. 6 shows a schematic sectional illustration at the point X-X according to FIG. 5. The blocking 43 acts on the cam disk 47 of the coupling element 46 of the nipper auxiliary shaft 39. In the embodiment shown by way of example, the blocking 43 consists of a latching lever 50 which is attached to a flange 52, wherein the flange 52 is held on the drive unit 2. The latching lever 50 in turn comprises a pin which engages through a bore in the flange 52 into a depression in the cam disk 47 of the coupling element 46 when a blocking position is reached. The blocking position of the latching lever 50 is shown by dashed lines in FIG. 6. In the latching lever 50, a transverse pin 51 is additionally arranged, which projects at right angles from the latching lever 50. The bore in the flange 52 is designed as a slit 53. In order to transfer the latching lever 50 into the blocking position, the latching lever 50 is rotated by 90 degrees about its axis until the orientation of the transverse pin 51 coincides with the slit 53. Subsequently, the latching lever 50 can be pushed in the direction of the nipper auxiliary shaft axis 40 through the slit 53 until it engages into a recess provided accordingly in the cam disk 47. Above, a position of the cam disk 47, and thus of the nipper auxiliary shaft 39, has been brought into an operating position intended for the adjustment of the ecartement.

The present invention is not limited to the embodiments shown and described. Modifications and a combination of the features within the scope of the claims are likewise possible, even if they are shown and described in different exemplary embodiments.

LEGEND

1 Machine frame
2 Drive unit
3 Conveyor belt
4 Combing head
5 Drive shaft
6 Gearing mechanism
7 Batting roll
8 Fiber strip
9 Conveyor table
10 Stretching unit
11 Calender rollers
12 Turntable
13 Canister
14 Operating device
15 Display
16 Nipper unit
17 Lower nipper plate
18 Nipper lip
19 Upper nipper plate
20 Feed cylinder
21 Circular comb
22 Circular comb axis
23 Circular comb segment
24 Pair of detaching rollers
25 Clamping line
26 Top comb
27 Batting
28 Fiber tuft
29 Nonwoven
30 Front pivot arm
31 Nipper axis
32 Drive arm
33 Nipper shaft
34 Nipper shaft axis
35 Half-shell
36 Screw
37 Eccentric
38 Distance sensor
39 Nipper auxiliary shaft
40 Nipper auxiliary shaft axis
41 Drive wheel of nipper auxiliary shaft

42 Gearing element
43 Blocking
44 Adjusting device
45 Protection device
46 Coupling element
47 Cam disk
48 Cam roller
49 Cam roller lever
50 Latching lever
51 Transverse pin
52 Flange
53 Slit
54 Additional display
55 Movement of the nipper auxiliary shaft
56 Movement of the nipper shaft
d Ecartement

The invention claimed is:

1. A combing machine, comprising:
a machine frame;
a plurality of combing heads arranged in the machine frame;
a drive unit, the combing heads connected to the drive unit;
a gearing mechanism arranged in the drive unit;
an operating device to use in inputting and displaying values;
a pair of detaching rollers forming a clamping line therebetween at each of the combing heads;
a nipper unit pivotably mounted in the machine frame at each of the combing heads, the nipper unit comprising:
a lower nipper plate with a nipper lip and an upper nipper plate, wherein an adjustable distance (d) is defined between the nipper lip of the lower nipper plate and the clamping line;
a drive arm connected to an intermittently-driven nipper shaft in a rotationally-fixed manner;
the nipper shaft driven by a nipper auxiliary shaft connected to a coupling element that is connected to a driven gearing element;
a mechanical blocking configured to fix the gearing mechanism in a basic position during adjustment of the distance (d);
an eccentric rotationally fixed on the nipper shaft;
a sensor disposed to measure a gap between the sensor and the eccentric; and
the operating device configured to correlate measurement of the gap to the distance (d) and to display the distance (d).

2. The combing machine according to claim 1, wherein the basic position corresponds to a position of the gearing mechanism in which the distance (d) is smallest.

3. The combing machine according to claim 1, wherein the coupling element is configured as a cam disk attached in a rotationally-fixed manner to the nipper auxiliary shaft; a cam roller resting against the cam disk; and a cam roller lever held in a rotationally-fixed manner on the nipper shaft and in which the cam roller is rotatably mounted, wherein the mechanical blocking is disposed to engage and block the cam disk.

4. The combing machine according to claim 1, wherein the mechanical blocking comprises a latching lever.

5. The combing machine according to claim 1, wherein a size of the display of the distance (d) on the operating device is adjustable.

6. The combing machine according to claim 1, wherein the operating device comprises an additional display at a region of an adjusting device, wherein the adjusting device is connected to the nipper shaft and is configured to change the distance (d) between the nipper lip of the lower nipper plate and the clamping line.

7. The combing machine according to claim 6, wherein one or both of the operating device and the additional display are rotatable or displaceable relative to the combing machine.

8. A method for adjusting the combing machine of claim 1, comprising:
transferring the gearing mechanism of the combing machine into the basic position;
fixing the gearing mechanism in the basic position with the mechanical blocking;
switching the operating device to display the distance (d) between the nipper lip of the lower nipper plate and the clamping line defined by the pair of detaching rollers at each of the plurality of combing heads of the combing machine;
releasing a connection between the coupling element and the nipper shaft, the nipper shaft driven by the nipper auxiliary shaft connected to the coupling element and the coupling element connected to the driven gearing element;
adjusting the distance (d) with an adjusting device;
securing the connection between the coupling element and the nipper shaft; and
releasing the mechanical blocking of the gearing mechanism; and
wherein the adjusting device is behind a protective door or cover and a display of the operating device automatically switches to a measurement value display of the distance (d) when the protective door or cover is opened and the connection between the coupling element and the nipper shaft is released.

9. The method according to claim 8, wherein when the protective door or cover is closed, the display of the operating device automatically switches back to a state before the adjustment.

* * * * *